US005558563A

United States Patent [19]

Cote et al.

[11] Patent Number: 5,558,563

[45] Date of Patent: Sep. 24, 1996

[54] METHOD AND APPARATUS FOR UNIFORM POLISHING OF A SUBSTRATE

[75] Inventors: William J. Cote, Poughquag; Michael F. Lofaro, Milton, both of N.Y.

[73] Assignee: International Business Machines Corporation, Armonk, N.Y.

[21] Appl. No.: 392,591

[22] Filed: Feb. 23, 1995

[51] Int. Cl.[6] ..... B24B 1/00

[52] U.S. Cl. ..... 451/41; 451/278; 451/285; 451/287; 451/288; 451/398; 451/527

[58] Field of Search ..... 451/41, 278, 59, 451/283, 285, 287, 288, 397, 398, 527, 528

[56] References Cited

U.S. PATENT DOCUMENTS 5,230,184 7/1993 Bukhman ..... 451/41

5,394,655 3/1995 Allen et al. ..... 451/41

5,435,772 7/1995 Yu ..... 451/41

*Primary Examiner*—Bruce M. Kisliuk

*Assistant Examiner*—Eileen P. Morgan

*Attorney, Agent, or Firm*—Whitham, Curtis, Whitham & McGinn; Alison Mortinger, Esq.

[57] ABSTRACT

A method and apparatus for improved control of polishing in chemical-mechanical polishing operations is provided. The polishing is controlled by applying different amounts of pressure to the surface of a substrate during polishing. A polishing pad which includes raised portions is used to apply the varying amounts of pressure. In addition, the position, size and height of the raised portions is used to affect the amount of pressure applied.

7 Claims, 15 Drawing Sheets

RING THICKNESS: 0.16 mm 0.48 mm

RING RADII = 100–180 mm, WAFER CENTER TRAVEL = 125–155 mm

RING THICKNESS: 0 mm 0.16 mm 0.48 mm

RING RADII = 100–180 mm, WAFER CENTER TRAVEL = 125–155 mm

METHOD AND APPARATUS FOR UNIFORM POLISHING OF A SUBSTRATE

BACKGROUND OF THE INVENTION

1. Field of the Invention

The invention is generally related to chemical-mechanical polishing operations performed during integrated circuit manufacturing, and particularly to polishing semiconductor wafers and chips which include integrated circuits. The invention is specifically related to polishing pad construction and operations that allow for improved control of polishing.

2. Description of the Related Art

Chemical-mechanical polishing (CMP) is performed in the processing of semiconductor wafers and/or chips on commercially available polishers, such as the Westech 372/372M polishers. The standard CMP tools have a circular polishing table and a rotating carrier for holding the substrate.

Generally, CMP does not uniformly polish a substrate surface, and material removal proceeds unevenly. For example, it is common during oxide polishing for the edges to the wafer to be polished faster than the center of the wafer. Although the reasons for this phenomenon are not clearly understood, insufficient slurry coverage of the polishing pad, and/or poor resiliency of the polishing pad, and/or the shape of the wafer carrier may all contribute to the problem.

Various methods have been attempted, with only limited success, to achieve uniform material removal from substrates by CMP. For example, the slurry coverage has been improved using pad conditioning. However, the conditioning apparatus can leave large particles on the pad which then cause scratches on the substrate. It is also possible to modify the shape of the wafer carrier, however, the shape which works well with one polishing pad may work poorly with another pad. In addition, modification of the shape of the wafer carrier may preclude the use of a two-table process in which different polishing pads and/or processes are used.

In addition, it is common for polishing pads to include a uniform pattern of perforations or embossed areas across the pad so that the slurry is brought on to the surface of the pad. The continuous pattern across the pad produces some improvement in the polishing action but does not correct the center to edge polishing variations across a substrate.

It is also difficult to control the CMP removal profile so that desired portions of a substrate are polished at faster rates than other portions.

In light of the foregoing, there exists a need for a method and device for controlling the removal of material from substrate such as semiconductor wafers and/or chips such that a uniform surface across the substrate can be achieved or such that materials from different portions of a substrate can be removed at different rates.

SUMMARY OF THE INVENTION

It is an object of this invention to provide a polishing pad and method to achieve uniform polishing and removal of materials from a substrate such as a semiconductor wafer or chip.

It is another object of this invention to provide a method and apparatus for controlling the rate of removal of materials from a substrate.

According to the invention, a polishing pad used in chemical-mechanical polishing is modified to allow the application of different pressures in polishing at different locations on the pad surface. In a particular embodiment, the polishing pad will be designed with raised and lowered regions on the polishing surface The polishing uniformity and rate of polishing can be adjusted and controlled through polishing pad configuration and selection.

BRIEF DESCRIPTION OF THE DRAWINGS

The various aspects, advantages, and principles of the present invention, and the preferred embodiments thereof, will be best understood by reference to the accompanying drawings in which.

DETAILED DESCRIPTION OF THE PREFERRED EMBODIMENTS OF THE INVENTION

Figure 1A:
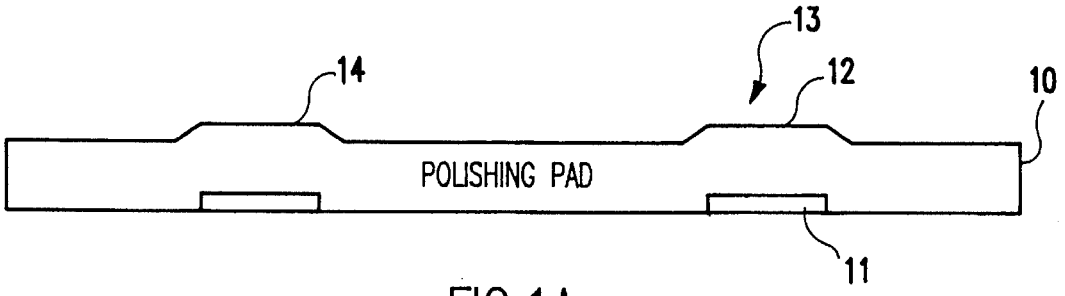
FIG. 1A is a side view of a polishing pad which includes two raised areas.

Referring now to the drawings, and more particularly to FIG. 1A, there is shown a cross-sectional side view of a polishing pad 10 which includes a full ring which is the raised portion. In the side view of the pad, the full ring produces two raised areas 12 and 14. Throughout the specification, unless otherwise stated, it should be assumed in cross-sectional side views that two raised areas which are labeled with the same number represent a full ring raised area. The raised areas 12 and 14 can be created by a wide variety of mechanisms. FIG. 1A specifically shows the use of shims 11 embedded in pad 10 at a location opposite the polishing surface 13.

Figure 1B:
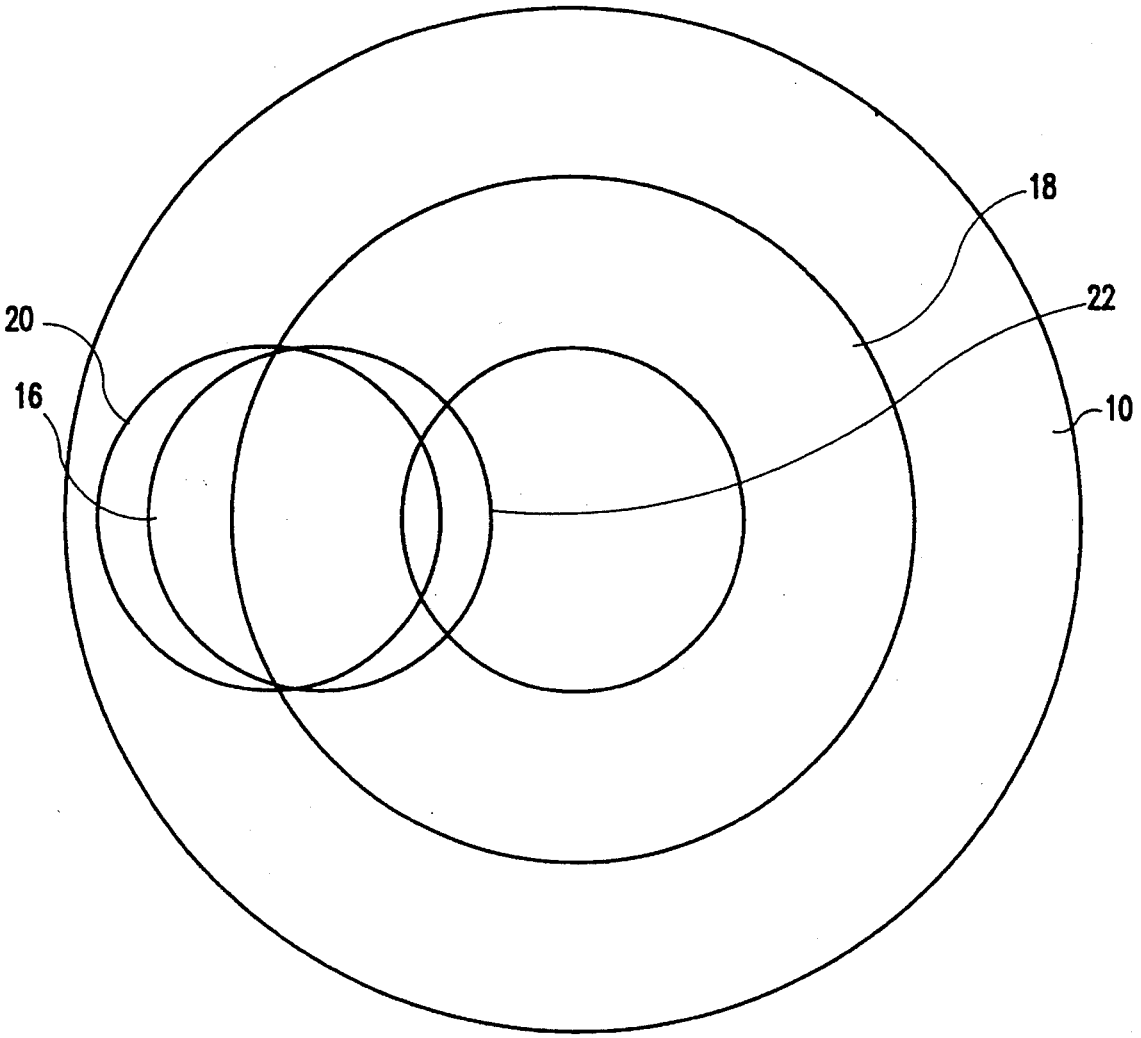
FIG. 1B is a plan view of a chemical mechanical polishing system according to the present invention.

FIG. 1B is a schematic plan view of the polishing pad 10 shown in FIG. 1A and of a semiconductor wafer 16. As shown, the polishing pad 10 includes a full ring raised portion 18 (identified in FIG. 1A as raised areas 12 and 14) located between the pad radii of 100 mm to 180 mm. As can be seen from FIG. 1B, the center of the wafer 16 is generally positioned away from the center of the polishing pad so that the wafer never crosses the center point of the polishing pad. In addition, it is common in CMP for the wafer to oscillate with respect to the polishing pad. As depicted in Figure 1B, the wafer 16 oscillates between a first position with an edge at 20 and a second position with an edge at 22. For exemplary purposes, the oscillation is approximately ±15 mm, however, the amount of oscillation can vary greatly and in certain instances, as will be discussed infra, will be 0 mm.

Figure 2A:
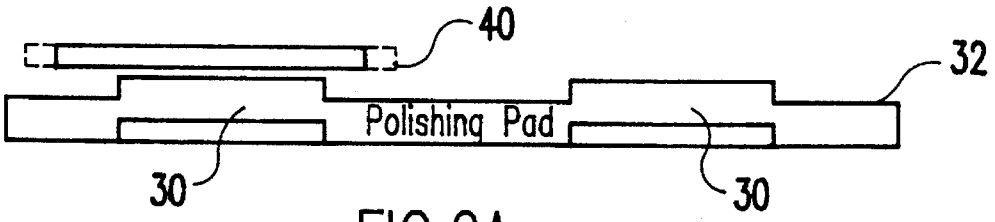
FIG. 2A is a cross sectional side view of a possible raised area pattern to be used to achieve faster polishing at the center of a substrate.
Figure 2B:
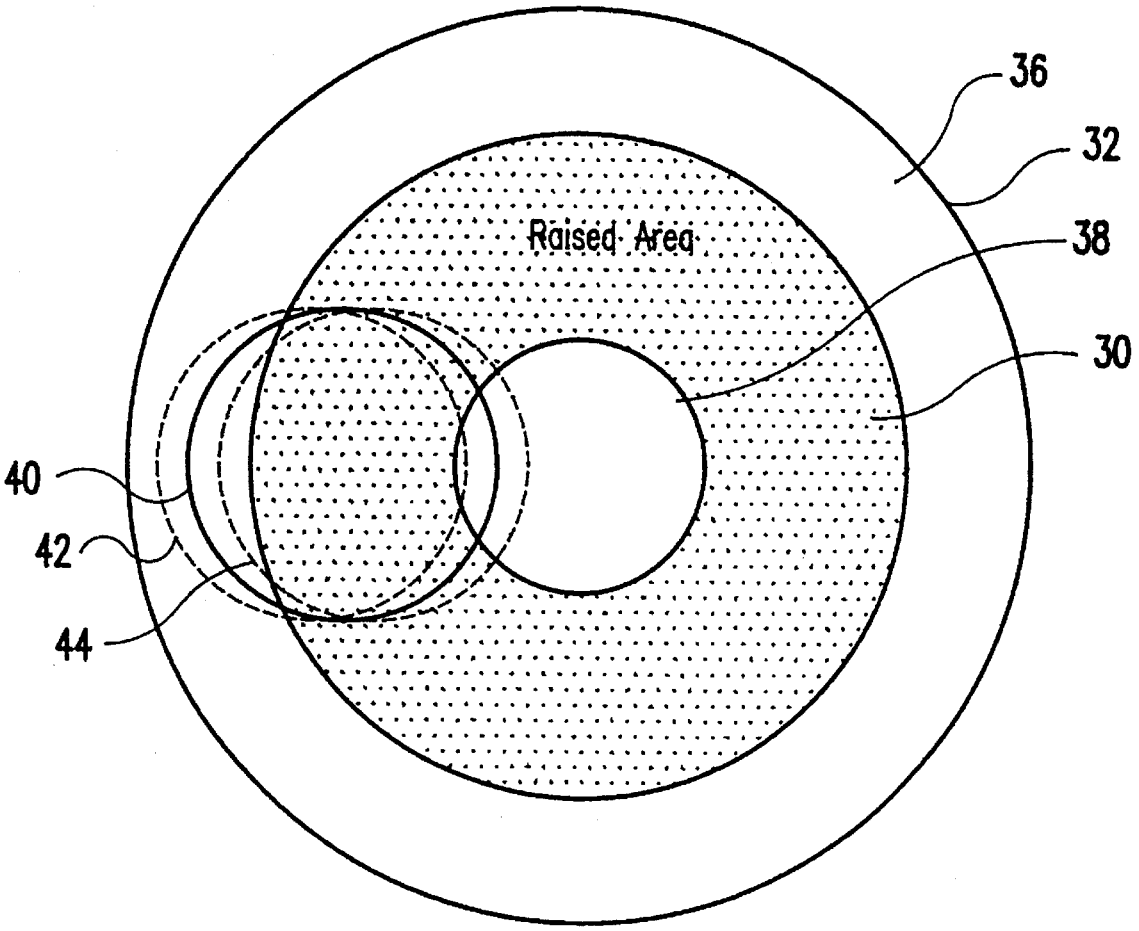
FIG. 2B is a schematic plan view of the raised area pattern shown in FIG. 2A.

An example of the patterns which can be used to provide different polishing rates and produce desired thickness profiles are shown in FIGS. 2A and 2B. In particular, FIG. 2A shows a cross sectional side view of a possible configuration which can be used to increase the polishing rate at the center of the wafer and/or decrease the polishing rate at the edge of the wafer. FIG. 2A shows a raised area 30 in the polishing pad 32, as well as the approximate relative location of a wafer 40. As can be seen, to achieve a faster polishing rate at the center of the wafer 40, the raised area 30 is positioned in the polishing pad 32 so that the center of the wafer 40 has more contact with the polishing pad 32.

FIG. 2B is a plan view in which a raised area 30 is provided in the polishing pad 32 between radii of approximately 70 mm to 200 mm where the center portion of a wafer 40 is polished. The polishing pad is not raised in the areas 36 and 38 which are oriented towards the edges of the wafer 40. The wafer 40 is shown to oscillate between positions 42 and 44.

Figure 2C:
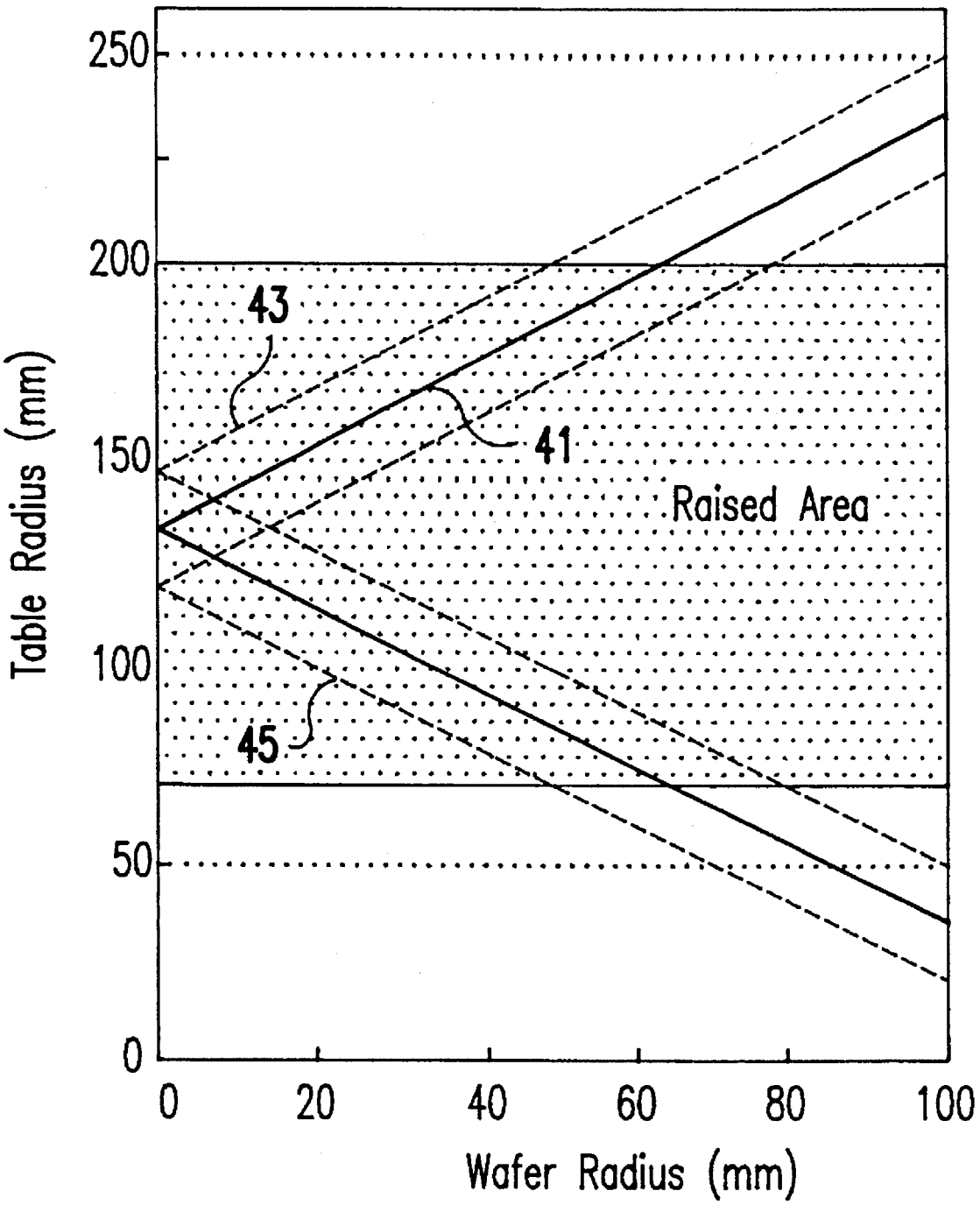
FIG. 2C is a graph showing the position of the raised area in relation to the relative position of a substrate on the table.

FIG. 2C is an example of a wafer position graph which is used to show the precise position of the wafer 40 relative to the radius of the table. This graph can be used to determine the size and position of the raised area 30 required for increasing and/or decreasing the polishing rate of a wafer 40 in the desired locations. As shown in the graph, the center of the wafer 40 is positioned at a table radius of approximately 135 mm, as shown be the point of 41. If there is oscillation, the center of the wafer varies between 125 mm and 150 mm as shown by the respective points of 43 and 45, respectively.

Figure 3A:
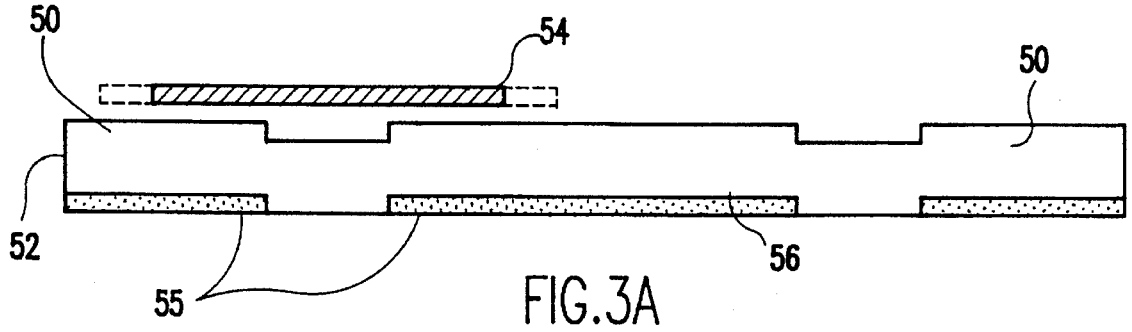
FIG. 3A is a cross sectional side view of a polishing pad with raised areas at the edge and at the center which can be used to increase the rate of polishing at the edges of a substrate.
Figure 3B:
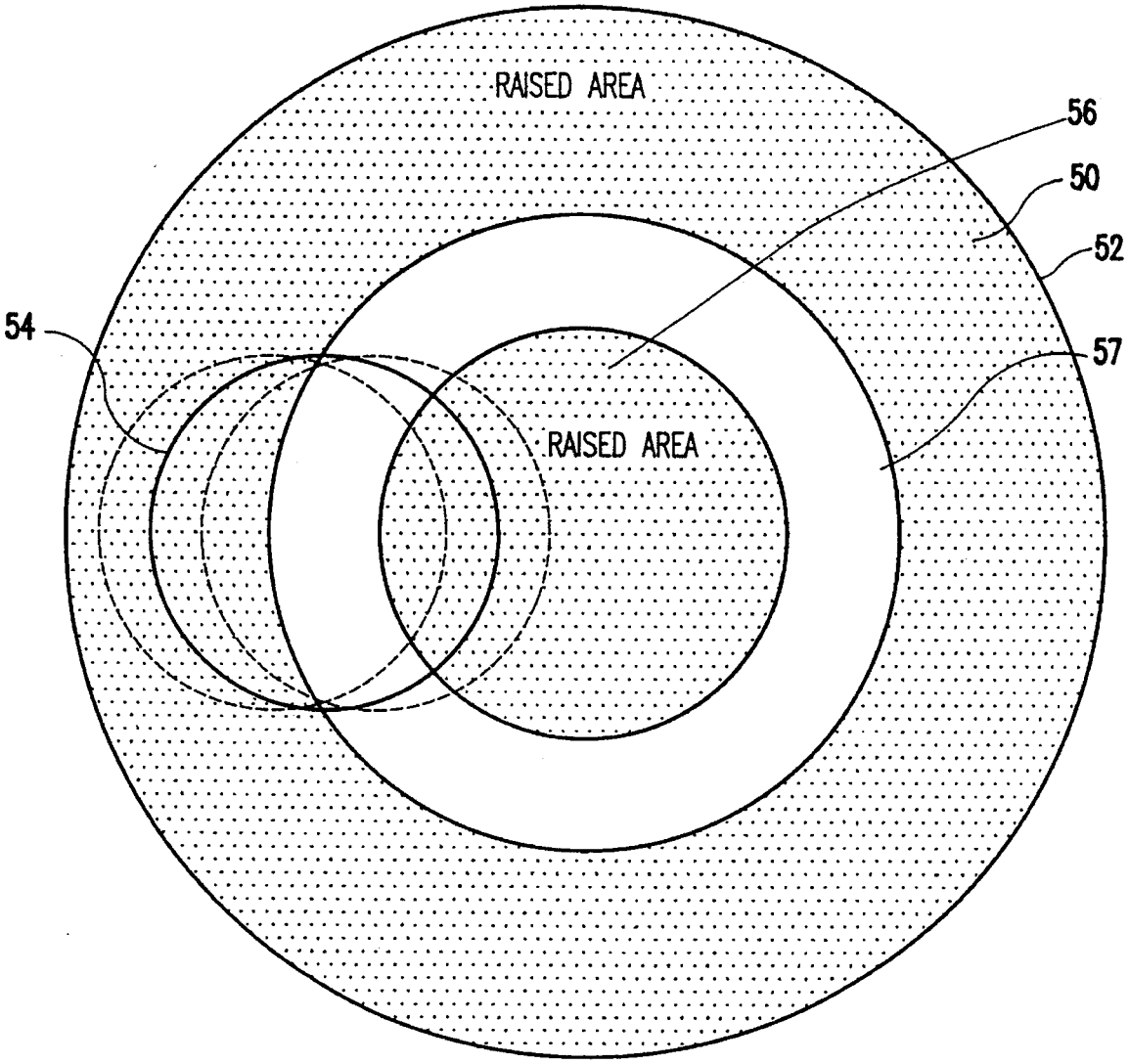
FIG. 3B is a schematic plan view of the raised area pattern shown in FIG. 3A.

FIGS. 3A and 3B illustrate a different raised area configuration in a polishing pad 52. The FIGS. 3A and 3B design can be used to correct faster polishing at the center of a substrate, or in other words, increase the polishing rate at the edges of a substrate. As shown in FIG. 3A, shims 55 or other devices can be used to form raised areas 50 and 56 which are at the edge and center of the polishing pad 52. The substrate 54 is positioned so that its center is located in a non-raised area 57.

FIG. 3B is a plan view of the configuration shown in FIG. 3A.

Figure 4:
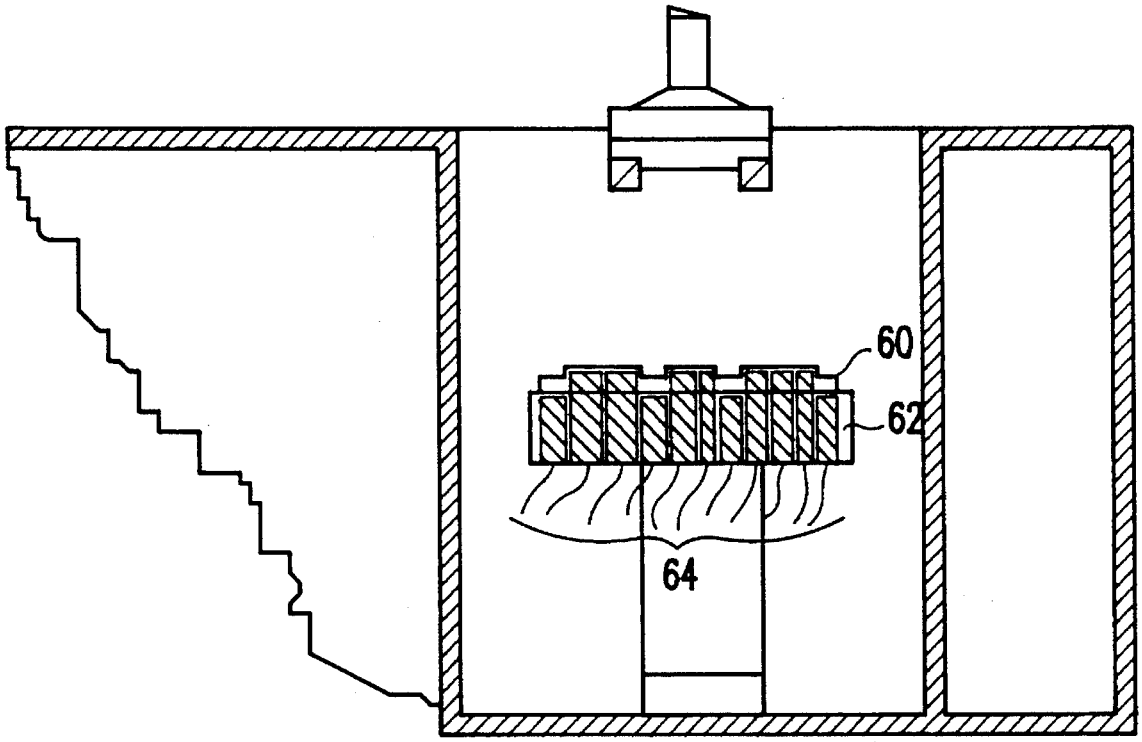
FIG. 4 is an illustration of a polishing table which includes pistons which can be moved up and down to produce raised areas in a polishing pad.

It should be understood that there are several possible methods to produce raised areas in the polishing pad. In particular, as shown in FIG. 3A, shims can be added to the polishing table or the polishing table can be machined so that the polishing table includes raised portions. It is also possible to form the raised areas within the polishing pad. A particularly flexible approach, shown in FIG. 4, is to provide a chemical mechanical polishing table 62 with an array of pistons 64 which can move up and down in the table underneath of the polishing pad 60. This method enables the raised area pattern to be modified easily and quickly. Moreover, the design shown in FIG. 4 can be used to dynamically control and adjust the polishing rate imposed across a substrate surface.

In a particular application of this invention, a polishing pad configuration can be chosen to eliminate a center to edge removal rate difference. In this example, the polishing is performed on a circular table with a radius of 260 mm. The polishing pad (Rodel Politex Supreme) and slurry (Cabot SC-1; diluted 2:1 with water) which were used are commercially available. 200 mm silicon (Si) wafers which were coated with silicon dioxide ($SiO_2$) using a PECVD process were used. The following polishing parameters were employed: a table and wafer carrier rotation rates of 25 and 20 RPM, respectively, pressure of 6 pounds per square inch, and flow of 150 sccm. The center of the wafers were polished at 135±15 mm from the center of the table, with an oscillation speed of 6 mm/second. The oxide thickness was measured before and after polishing.

Figure 5:
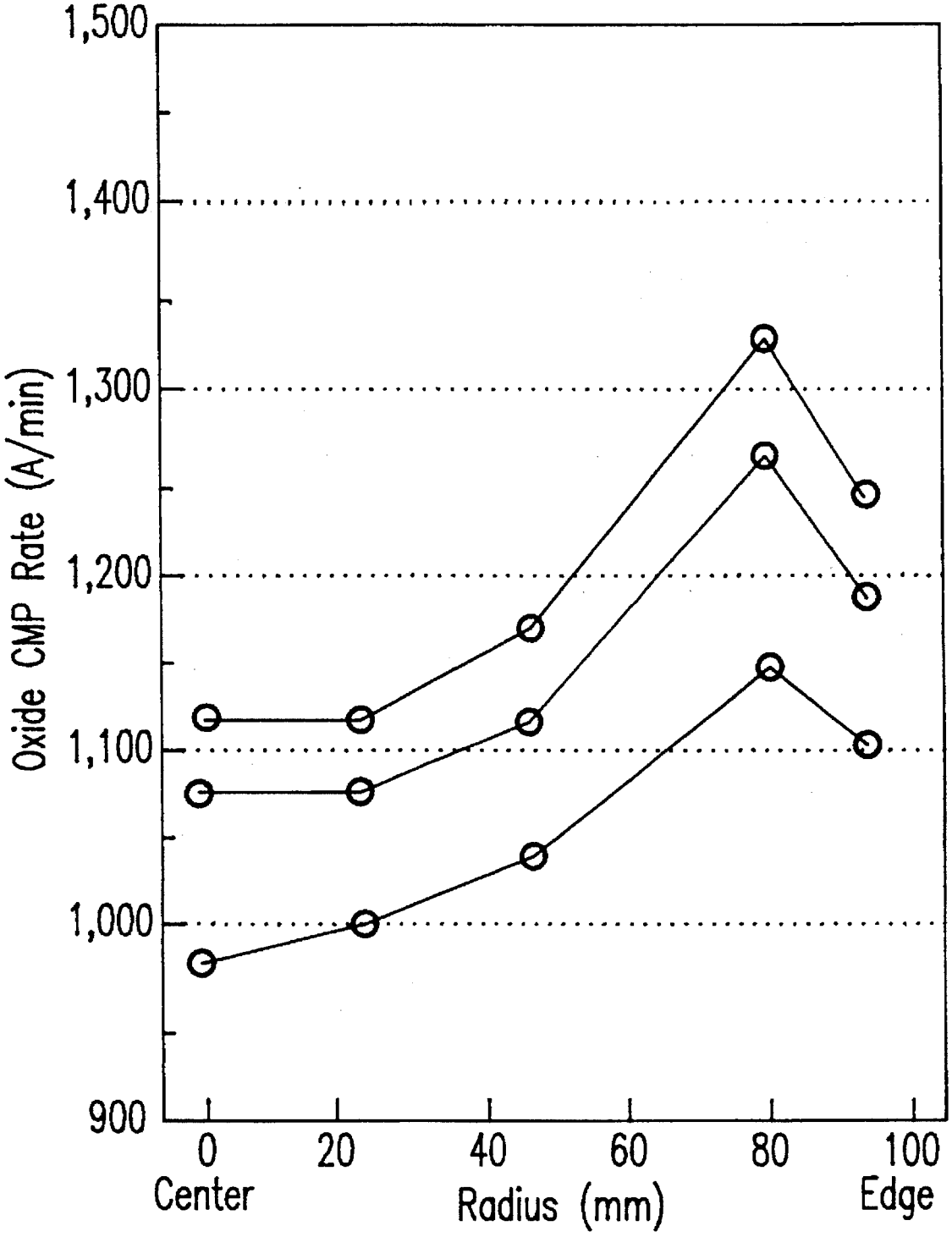
FIG. 5 is a graph which illustrates the removal rate of material from across a wafer surface using prior art techniques.

FIG. 5 shows the material removal rate achieved across the surface of a wafer when a standard, prior art method in which a polishing pad having no raised areas is used to polish a substrate, under the conditions described above. The results for three different wafers are provided to show the similar effects seen. As is shown in the graph, the maximum oxide removal rate for all three wafers was observed at 80 mm from the center of the wafer. At this location, the removal rate was greater than 20% faster than the removal rate at the center of the wafer.

Figure 6A:
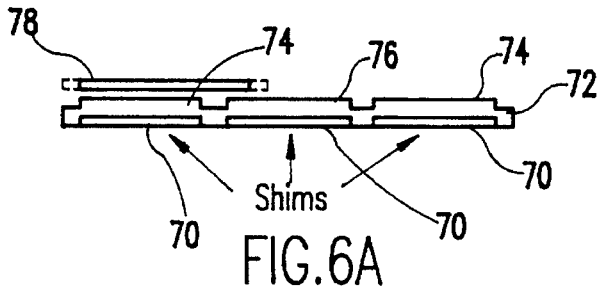
FIG. 6A is a side view of a polishing pad showing the raised area positioned to eliminate center to edge removal rate differential.

A second experiment was performed using the same conditions described above except that modifications were made to the polishing pad in accordance with the present invention. In this particular example, as shown in FIG. 6A, shims 70 with a thickness of 0.48 mm were placed on a flat polishing table in the pattern. A polishing pad 72 was then placed on top of the shims, thereby forming raised areas 74 and 76 in the pad which corresponded to the shim pattern. The graph in FIG. 6C shows the positions of the raised areas with respect to the table radius. As can be seen, raised areas where placed from table radius 0 mm to 65 mm and at 95 mm to 230 mm.

Figure 6B:
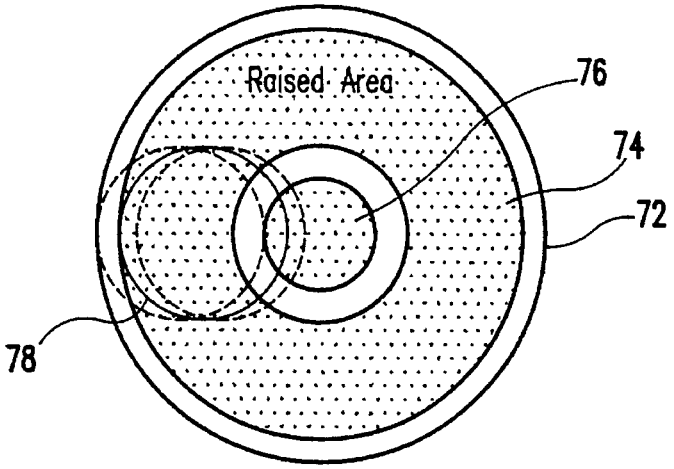
FIG. 6B is a plan view of the polishing pad shown in FIG. 6A.
Figure 6C:
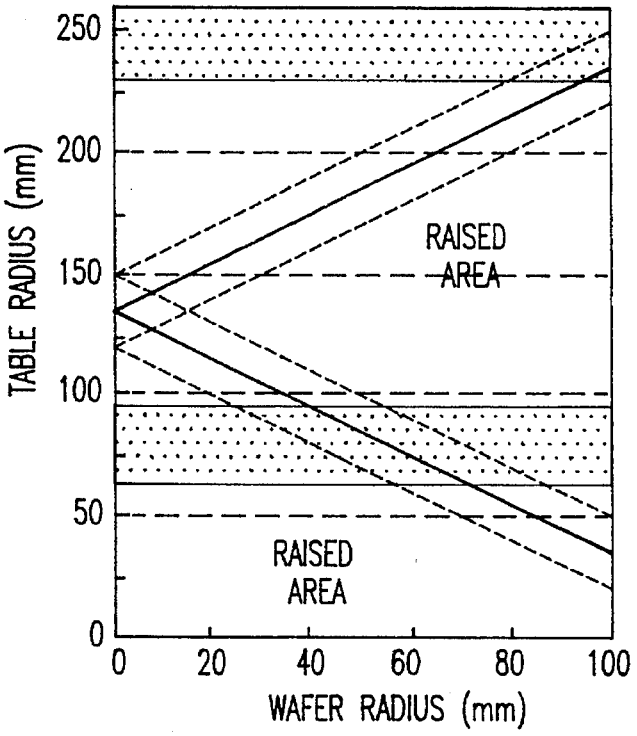
FIG. 6C is a graph showing the relative ring locations shown in FIG. 6A which were determined from the radii of the substrate and the table.

FIG. 6B is a schematic plan view which shows the large ring raised area 74, located at table radius from 95 mm to 230 mm, was placed so as to increase the polishing rate at the center of the wafer or at the 0 mm to 25 mm wafer radius and to decrease the polishing rate at the edges or at the 80 mm to 100 mm wafer radius. A circle in the center of the table 76, at table radius 65 mm, was positioned to restore the polishing rate at the edge of the wafer, at wafer radius 90 mm to 100 mm.

It is also possible to increase the polishing rate at wafer radius 90 mm to 100 mm by adding a raised ring at the edge of the table, for example at 245 mm–250 mm. However, since the linear velocity of the table is proportional to the table radius, a greater effect on the polishing rate will be obtained by placing the raised area at the edge of the table compared to a raised area at the center of the table. In the instant case, a center raised area was used since less augmentation was necessary. In particular, as shown in the graph in FIG. 5, the polishing rate at wafer radius 94 mm is still high relative to the wafer center.

Oxide wafers were then polished using the polishing pad set-up shown in FIGS. 6A and 6B. The removal rate difference across the three wafers tested was shown to be less than 10%, as can be seen from the graph in FIG. 7. Therefore, the raised areas of the pad were able to correct the increased polishing rate which was seen at the approximately 80 mm radius of the wafer.

Figure 7:
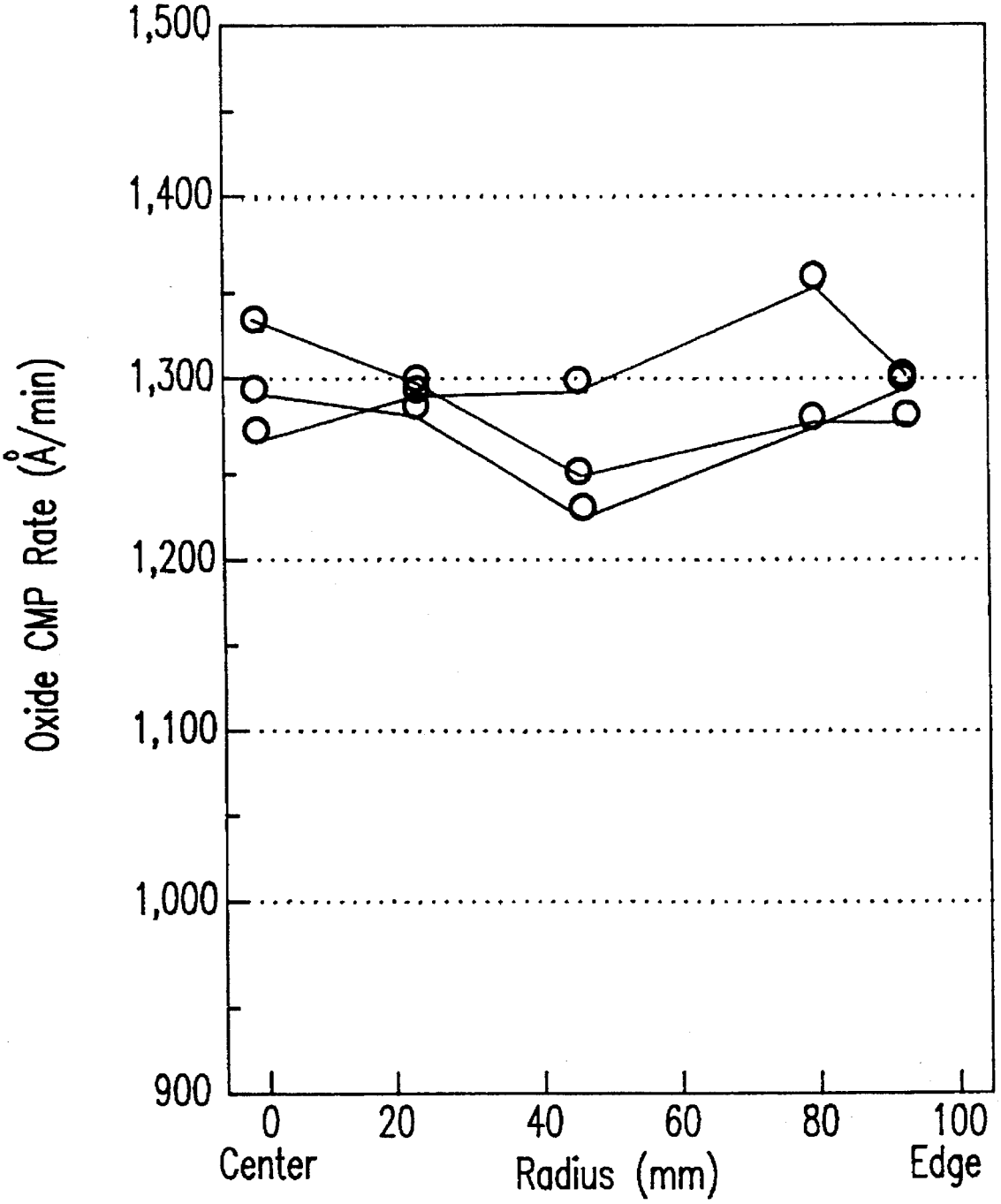
FIG. 7 is a graph of the removal rate of material across a wafer surface using the polishing pad configuration as set forth in FIGS. 6A, 6B and 6C.
Figure 8A:
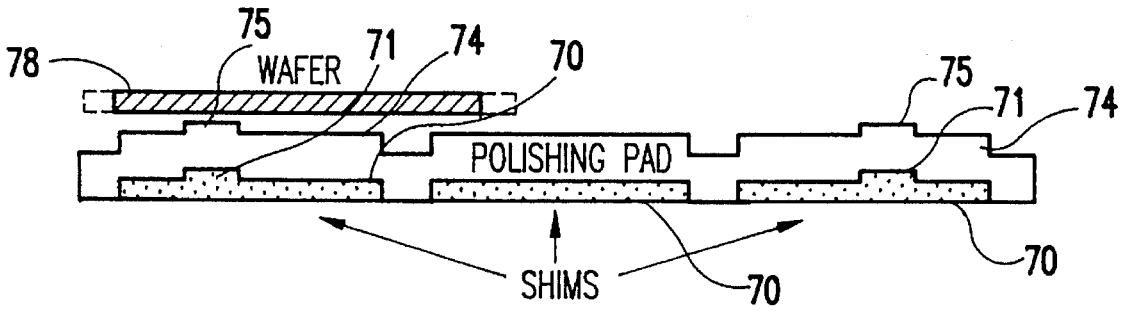
FIG. 8A is a side view and FIG. 8B is a plan view of a two-tiered polishing pad configuration which can be used to further improve on the removal profile obtained using the configuration shown in FIGS. 6A, 6B and 6C.
Figure 8B:
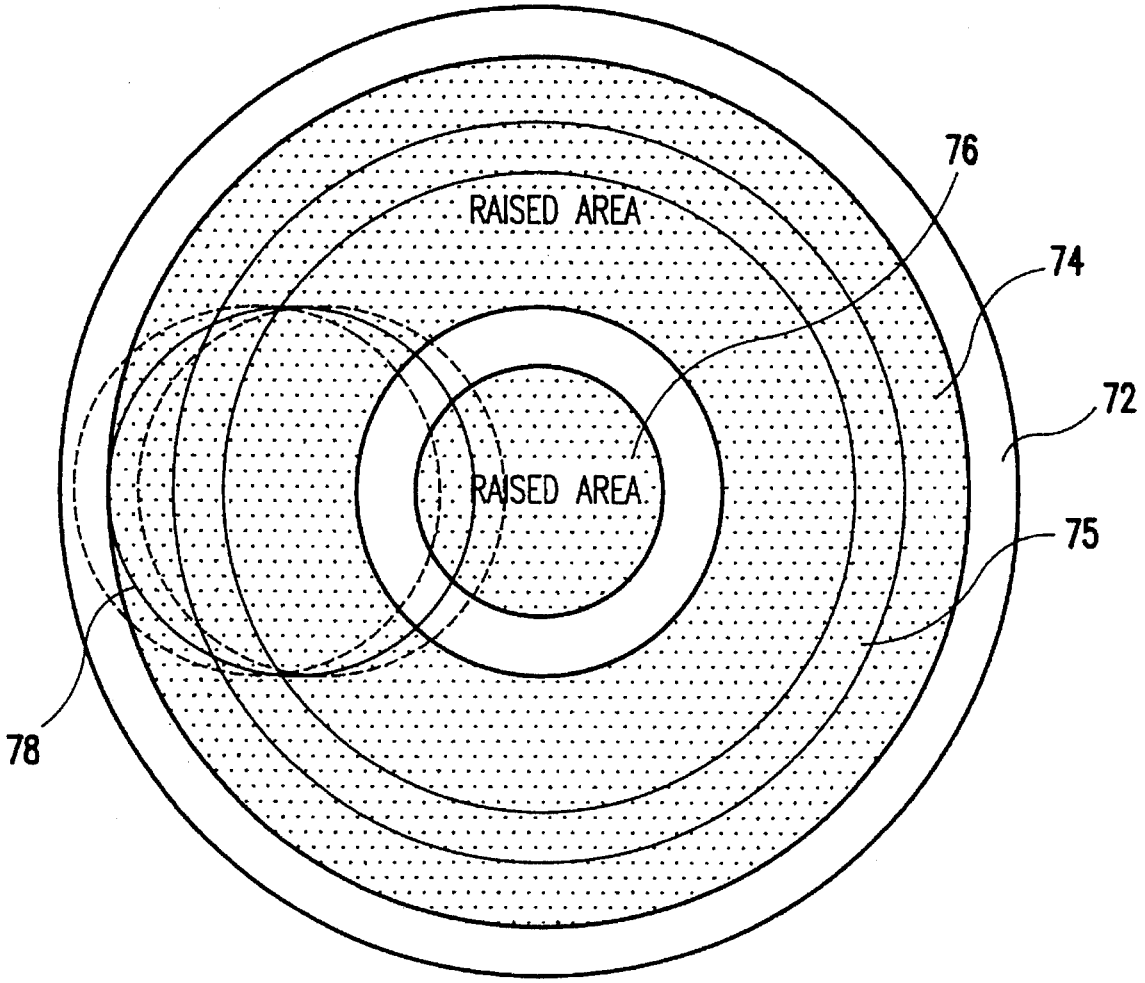

It is possible to further improve the thickness profile obtained using the set-up shown in FIGS. 6A and 6B. As shown in FIG. 7, the minimum thickness is at wafer radius approximately 40 mm. In order to obtain a more uniform removal profile, the polishing pad configuration shown in FIGS. 8A and 8B could be used. In this approach, a second raised area 75 can be created by placing an additional shim 71 on top of the first shim 70 to make a two-tiered raised area.

Figure 9B:
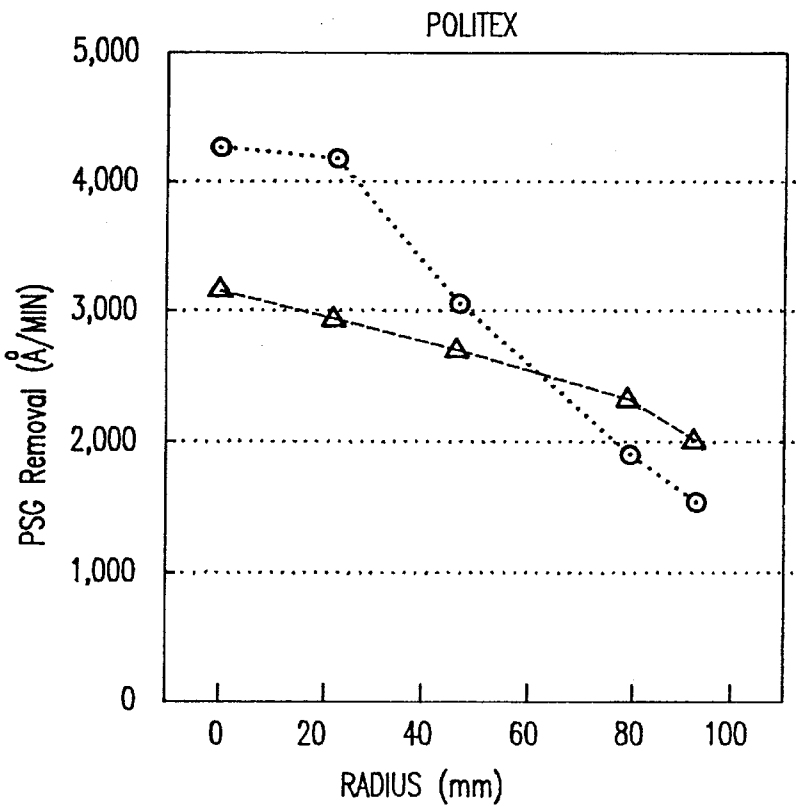
FIGS. 9A and 9B are graphs showing the effect of the raised area ring thickness on the relative polishing rate for two different types of polishing pads.
Figure 9A:
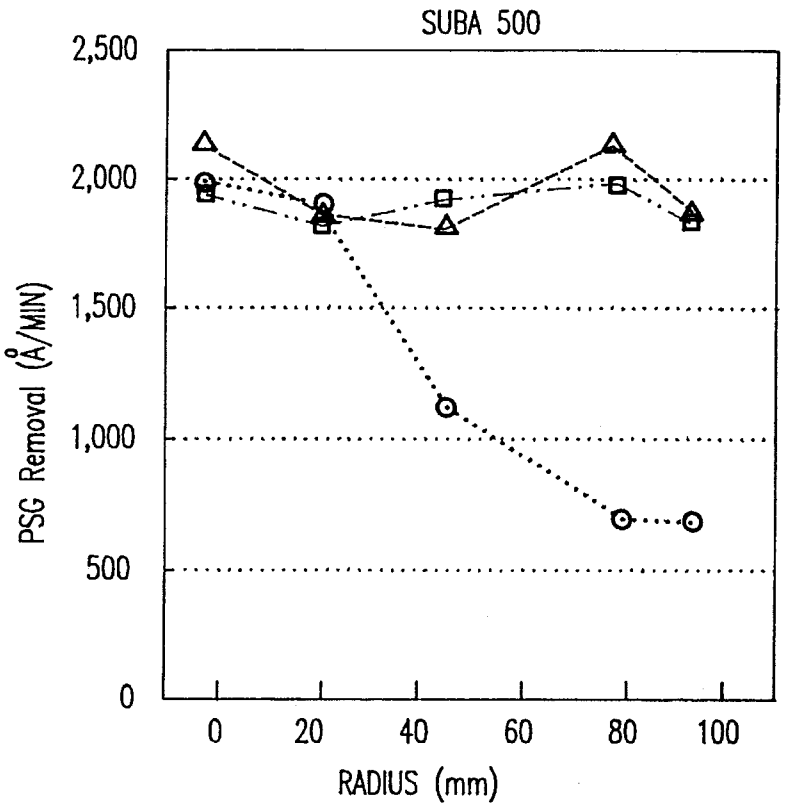

The amount of the polishing rate increase and/or decrease depends on a variety of factors which can be used in different combinations to achieve the desired results. A first factor is the height of the raised area, wherein the relative polishing rate increases as the step height of the raised area increases. FIGS. 9A and 9B are graphs of the effect of the ring thickness on the relative polishing rate for PSG removal for two types of polishing pads. In FIG. 9A, a Suba 500 polishing pad is used in comparing the polishing rate across the radius of the wafer for raised areas of varying step heights, 0 mm, 0.16 mm and 0.48 mm. The raised area is located at 100 mm to 180 mm from the center of the polishing and the wafer oscillation is approximately ±15 mm. FIG. 9B shows a similar experiment using a Politex polishing pad with raised areas of thicknesses 0.16 mm and 0.48 mm. As is shown in the graphs, as the height of the raised area increases the polishing rate increases. Furthermore, the the effect of the height of the raised area is greater using the Politex polishing pad than with the Suba polishing pad. Therefore, the type of polishing pad can be varied to modify the effects of the raised area on the polishing rate.

A second factor is the relative width of the raised portion. In general, as the width of the raised portion decreases, the relative polishing rate increases in conjunction with an increase in pressure. Therefore, a thin, full ring will polish faster than a thick, full ring since more pressure is applied on the smaller area.

A third factor is whether the raised areas are full rings and circles, an arc equal to 360 degrees, or are partial rings and circles, an arc less than 360 degrees. A partial ring or circle can be used to attenuate a polishing rate increase as compared to a full ring or circle. The effect can be described as duty cycle since the size of the ring corresponds to the augmentation percentage of the polishing cycle. For instance, the use of a full ring produces an augmentation of the polishing rate over 100% of the polishing cycle. In contrast, a ½ ring results in an augmentation of the polishing rate over 50% of the polishing cycle and no augmentation in the other 50% of the polishing cycle.

Figure 10B:
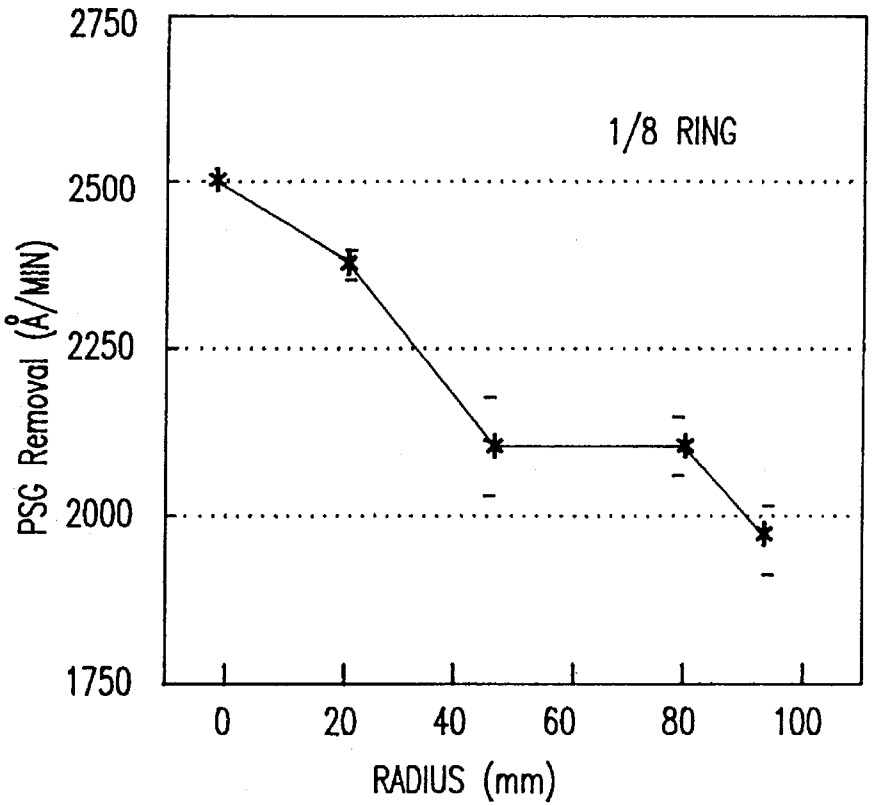
FIG. 10B is a graph showing the effect of the use of a ⅛ raised area ring on the polishing rate.
Figure 10A:
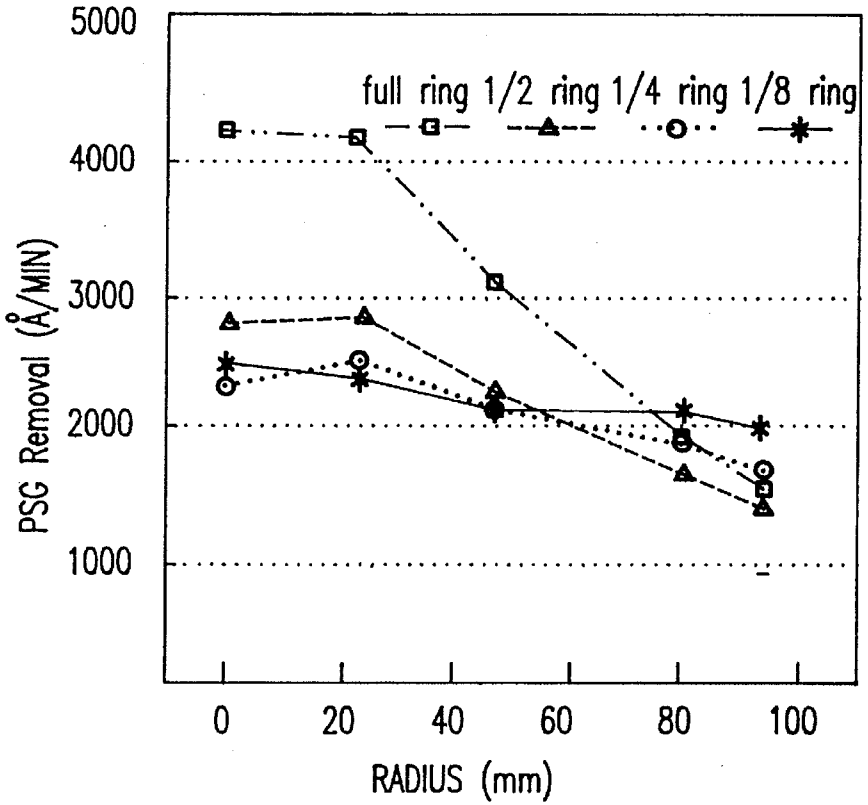
FIG. 10A is a representative plot comparing the effects of the use of full and partial raised area rings on the polishing rate.

FIG. 10A is a graph which provides a comparison of the effects of the use of a full ring to the use of partial rings, including ½ ring, ¼ ring and ⅛ ring. In these examples, the raised rings in the polishing pad were located between 100 mm and 180 mm radius and PSG is being removed. The graph shows that over the radius of the wafer the partial rings were able to achieve more uniform removal rates. The use of the full ring produced the fastest polishing at the center and the slowest at the edges. FIG. 10B shows the removal rate, in more detail, for the ⅛ ring.

Figure 11A:
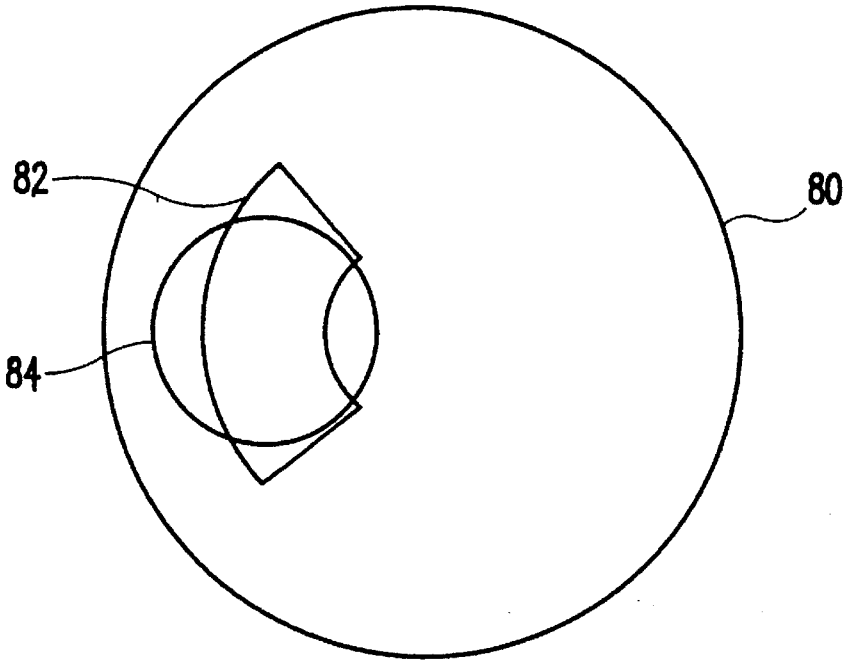
FIG. 11A is a schematic illustration of a ¼ ring raised area in a polishing pad.
Figure 11B:
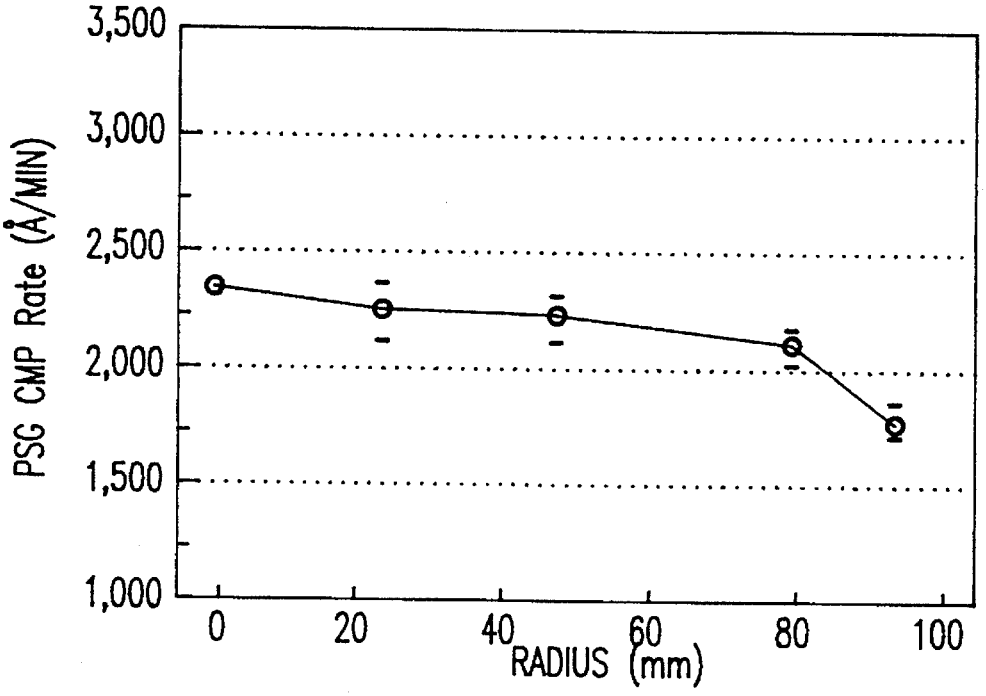
FIG. 11B is a graph showing the relative polishing rate across a substrate using the configuration shown in FIG. 11A.
Figure 11C:
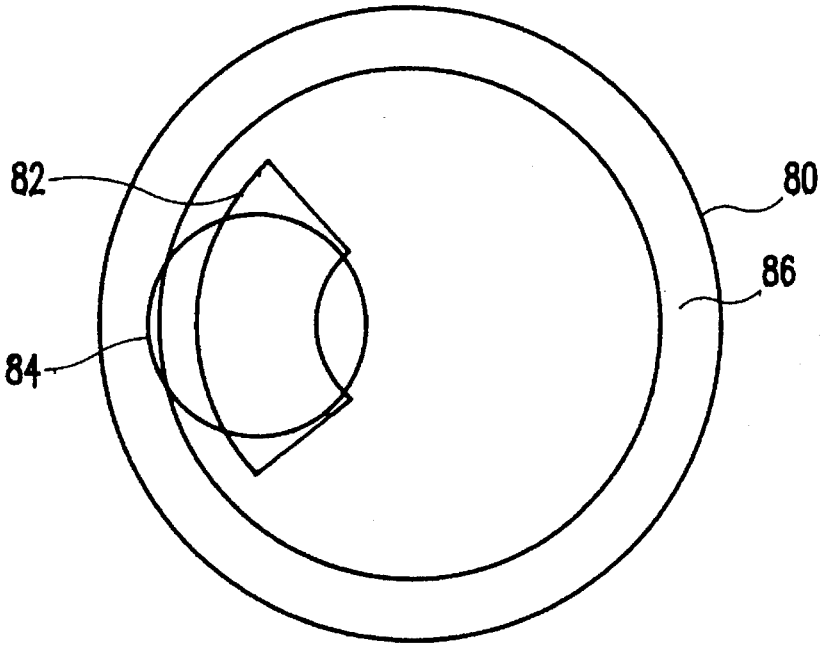
FIG. 11C is a schematic illustration of a polishing pad with ¼ ring raised area and a full ring raised area
Figure 11D:
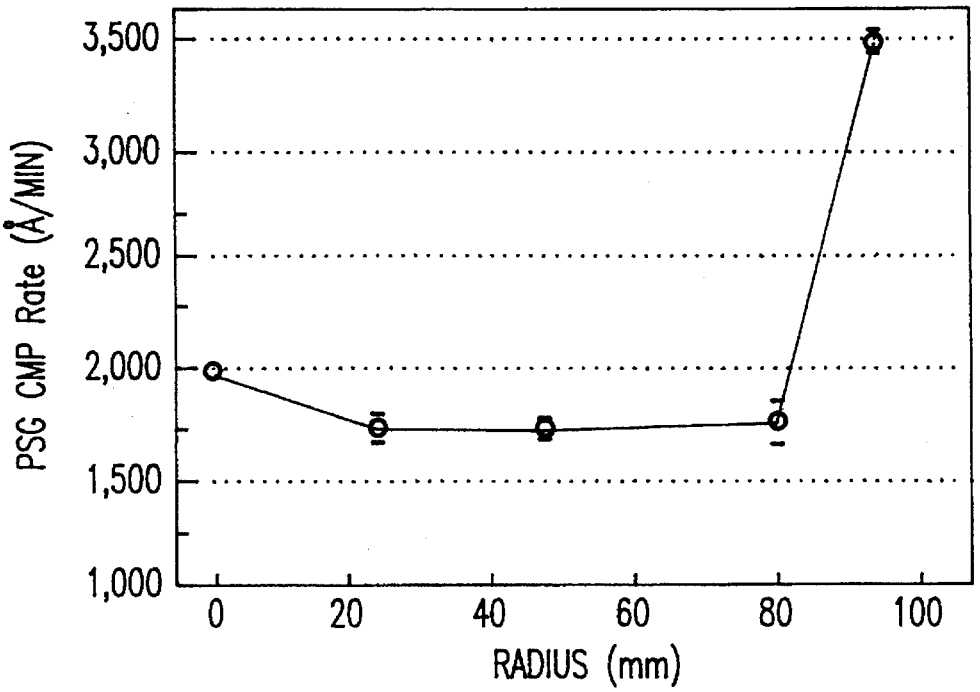
FIG. 11D is a graph showing the relative polishing rate across a substrate using the configuration shown in FIG. 11C.

Other combinations of rings and raised areas can be used to achieve various desired results. As shown in FIGS. 11A, a ¼ ring raised area 82 is placed between 80 mm and 200 mm radius of the polishing pad 80. When the wafer is polished using the configuration shown in FIG. 11A, the thickness uniformity across the wafer is within 5% except in the area from 80 mm to 90 mm, as is shown in the graph in FIG. 11B. In order to remedy the slower removal rate at the edge of the wafer, from 80 mm to 90 mm, a raised area 86 was placed at the edge of the polishing pad between 230 mm and 285 mm, as is shown in FIG. 11B. However, as can be seen from the graph in FIG. 11D, the raised area between 230 mm and 285 mm overcompensated and provided too much polishing at the edge of the wafer. Another approach to improve the uniformity across the wafer is to use a partial ring raised area at the edge of the table, or to use a full or partial raised area at the center of the table. It would also be possible to reduce the height of the raised area at the edge of the table.

Figure 12A:
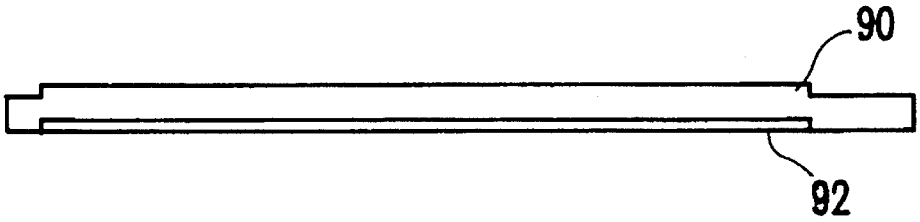
FIG. 12A is a side view of a possible configuration of a raised area in a polishing pad which includes an offset ring thereby creating the effect of oscillation.
Figure 12B:
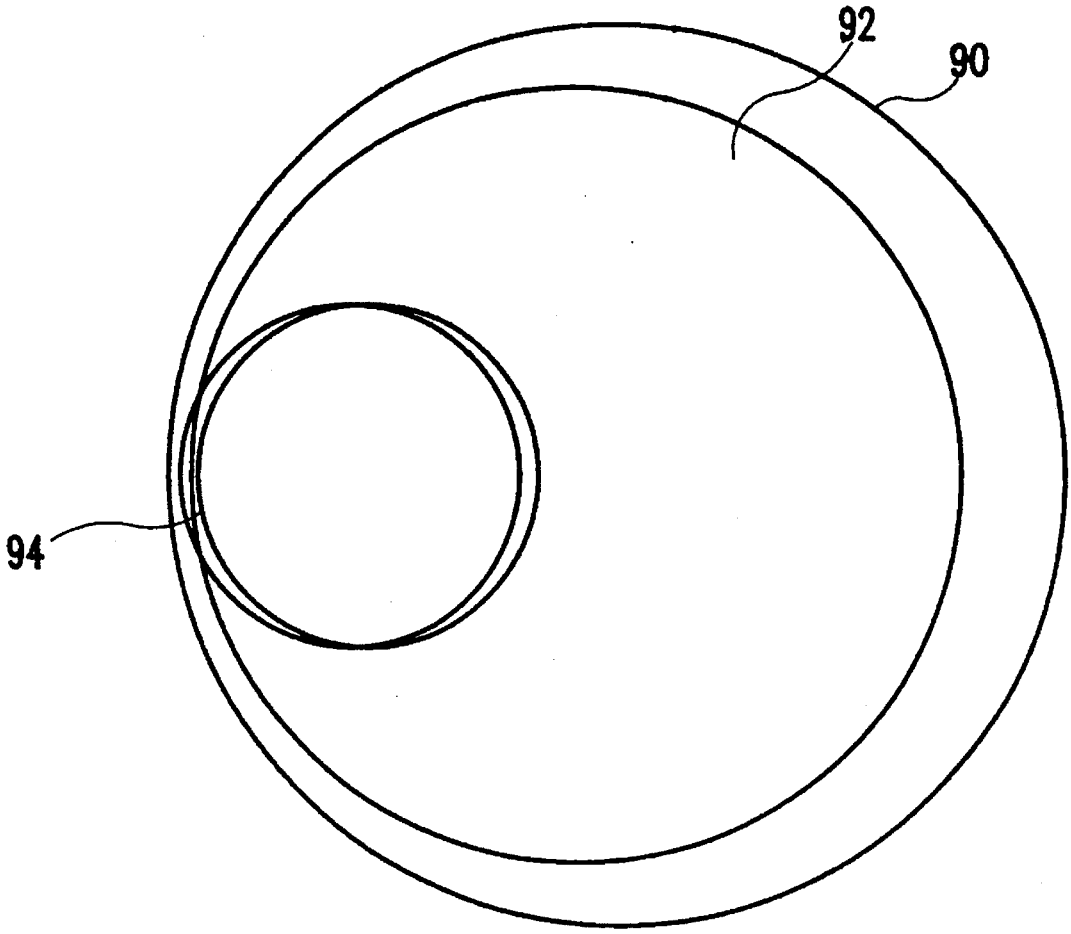
FIG. 12B is a schematic plan view of the raised area pattern shown in FIG. 12A.
Figure 12D:
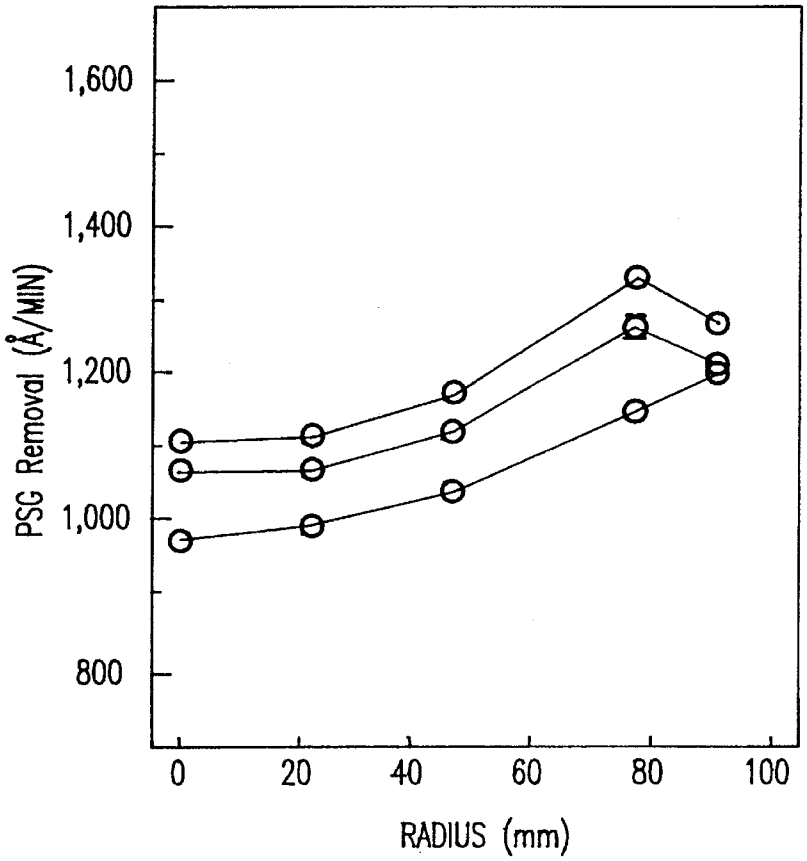
FIGS. 12C and 12D are graphs which compare the removal profile achieved with an offset ring in a polishing, as shown in FIG. 12A, and without an offset ring, respectively.
Figure 12C:
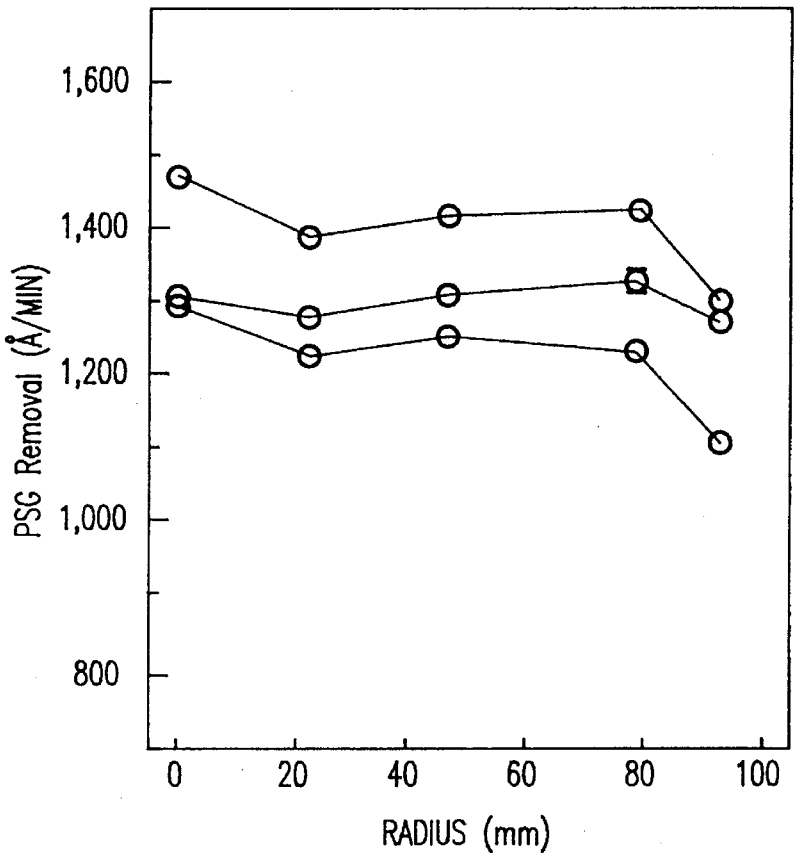

It is also possible to place a raised area in a polishing pad so as to create an effect of oscillation on the table. It has been found that a relatively large oscillation rate is particularly useful in preventing an abrupt change in the removal rate across the wafer. FIG. 12A provides a cross sectional side view of a possible configuration of a raised area 92 in a polishing pad 90 in which a raised circle or a ring is placed so that it is offset with respect to the center of the table. As shown in FIG. 12B, the raised area 92 in the polishing pad 90 is closer on one portion to the edge so that the outer edge of the wafer 94 is only in contact with the raised portion of the polishing pad over a portion of the entire surface of the pad. In this example, the polishing pad has a radius of 260 mm and the circle has a radius of 225 mm and the offset is 20 mm. It has been found that the use of the offset raised circle creates the effect of oscillation of the table. A graph of the removal rate across three different wafers wherein an offset circle raised area has been placed in the polishing pad is shown in FIG. 12C. A comparison of the same conditions on three different wafers using a pad with no raised area is shown in FIG. 12D. As can be seen, the use of the offset circle produces a more uniform center to edge removal profile.

In addition to varying the configuration, size and placement of the raised areas, the types of polishing pad and slurry can affect the polishing rate. In the example described above, the combination of the polishing pad and the slurry which was used produced a polishing profile in which the edge polishing rate is faster than the center rate. Each of these situations can be addressed by using various combinations of raised areas and pressure.

In other instances, the semiconductor wafer has a non-uniform thickness profile before polishing and it is desired to produce a uniform thickness profile after polishing. In this case, even if the center to edge polishing rate profile is uniform, it is desired to control the polishing rate on particular portions of the wafer. For example, if the film is thicker at the edges of the wafer than at the center, then the raised area pattern shown in FIGS. 2A and 2B can be used to produce the correct profile after polishing.

The examples provided above are used for illustrative purposes and it should be understood that different combinations of polishing pad, slurry, polishing carrier, and table size can be used depending on the film which is to be removed, the thickness profile prior to polishing and the desired final profile. In addition, these factors determine the combinations of pattern and step height of the raised areas which are used to produce the desired final thickness profile.

While the invention has been described in terms of its preferred embodiments, those skilled in the art will recognize that the invention can be practiced with modification within the spirit and scope of the appended claims.

We claim:

1. A method for polishing a substrate, comprising the steps of:

contacting a surface of a substrate with a polishing pad while at least one of said substrate and said polishing pad moved so as to polish said surface of said substrate with said polishing pad;

placing a plurality of pistons adjacent a non-polishing surface of said polishing pad, said plurality of pistons being positionable in an up position and a down position; and simultaneously applying a first amount of pressure on a first portion of said surface of said substrate with said polishing pad during said contacting step and a second amount of pressure which is different from said first amount of pressure on a second portion of said surface of said substrate with said polishing pad during said contacting step by adjusting positions of pistons in said plurality of pistons up or down to produce a polishing surface for said polishing pad which has at least one comparatively raised first portion and at least one comparatively lower second portion.

2. An apparatus for polishing a substrate, comprising:

a carrier for holding a substrate;

a polishing pad;

a housing for holding said polishing pad, said polishing pad being positioned in close proximity to said carrier, wherein at least one of said carrier and said polishing pad being movable so as to polish a surface of said substrate with said polishing pad; and a shim positioned in said housing behind said polishing pad, said shim being smaller than said polishing pad and said polishing pad conforms over said shim positioned in said housing, whereby said shim creates at least one comparatively raised first portion and at least one lowered second portion on a polishing surface of said polishing pad which contacts said substrate.

3. An apparatus, as recited in claim 2, wherein one of said at least one raised first portion of said polishing surface of said polishing pad extends radially around a 360° arc about a central rotational axis of said polishing pad.

4. An apparatus, as recited in claim 2, wherein one of said at least one raised first portion of said polishing surface of said polishing pad extends in a radial arc of less than 360° about a central rotational axis of said polishing pad.

5. The apparatus of claim 2 wherein said polishing pad is circular and has a first diameter and said shim is circular and has a second diameter which is less than said first diameter, and wherein said shim is positioned within said housing at a location where a center point of said shim is offset from a center point of said polishing pad.

6. The apparatus of claim 2 wherein said shim has a first region having a first height, and a second region with a second height greater than said first height, said shim creating at least a third comparatively raised portion on said polishing surface of said polishing pad, wherein said third comparatively raised portion is of a greater height than said first comparatively raised portion.

7. An apparatus for polishing a substrate, comprising:

a carrier for holding substrate and a polishing pad positioned in close proximity to said carrier, at least one of said carrier and said polishing pad being moveable so as to polish a surface of said substrate with said polishing pad; and a plurality of pistons adjacent a non-polishing surface of said polishing pad, said plurality of pistons being positionable in an up position and a down position, wherein pistons in said plurality of pistons are positioned to produce a polishing surface for said polishing pad which has at least one comparatively raised first portion and at least one comparatively lower second portion.

* * * * *